US006890273B1

(12) United States Patent
Perez

(10) Patent No.: US 6,890,273 B1
(45) Date of Patent: May 10, 2005

(54) GOLF PUTT-LINE VARIANCE DETERMINING SYSTEM

(76) Inventor: Basilio Perez, 9900 Marnice Ave., Tujunga, CA (US) 91042

( * ) Notice: Subject to any disclaimer, the term of this patent is extended or adjusted under 35 U.S.C. 154(b) by 0 days.

(21) Appl. No.: 10/629,238

(22) Filed: Jul. 28, 2003

(51) Int. Cl.[7] ..... A63B 57/00; A63B 69/36
(52) U.S. Cl. ..... 473/404; 473/407
(58) Field of Search ..... 473/404, 407, 473/405, 409, 221, 222; 33/700, 701

(56) References Cited

U.S. PATENT DOCUMENTS

| | | | | | |
|---|---|---|---|---|---|
| 5,046,839 | A | * | 9/1991 | Krangle | 473/407 |
| 5,330,188 | A | | 7/1994 | Reimers | 273/186.1 |
| 5,403,001 | A | * | 4/1995 | Skorpinski | 473/409 |
| 5,486,002 | A | | 1/1996 | Witler et al. | 273/184 |
| 5,582,566 | A | * | 12/1996 | Imasaka et al. | 473/407 |
| 5,692,966 | A | | 12/1997 | Wash | 473/221 |
| 5,810,674 | A | * | 9/1998 | Falossi et al. | 473/407 |
| 5,818,036 | A | | 10/1998 | Daly | 250/216 |
| 6,129,641 | A | * | 10/2000 | Burch | 473/404 |
| 6,165,083 | A | * | 12/2000 | Stenger et al. | 473/404 |
| 6,364,785 | B1 | | 4/2002 | Chen | 473/222 |
| 6,458,038 | B1 | | 10/2002 | Lin | 473/220 |
| 6,461,247 | B1 | | 10/2002 | Riddell | 473/219 |

* cited by examiner

*Primary Examiner*—Steven Wong
(74) *Attorney, Agent, or Firm*—Goldstein Law Offices, P.C.

(57) ABSTRACT

An offset measurement system, for aiding a golfer when putting upon a putting green having varying slope between a golf ball, resting upon the green, and a hole having a hole center. A target having a target line is positioned at the hole with the target line aligned with a direct putt line that connects the hole center and ball. A measurement device is used to acquire multiple measurement data sets having the slope of the putting green at a position along the direct putt line and a distance to the target at that position. The measurement device calculates and displays a recommended offset distance from the measurement data sets that is used by the golfer to redirect the putt at the hole by the recommended offset distance from the direct putt line.

17 Claims, 6 Drawing Sheets

GOLF PUTT-LINE VARIANCE DETERMINING SYSTEM

BACKGROUND OF THE INVENTION

The invention relates to a golf putt-line variance determining system. More particularly, the invention relates to a system that measures the topography along a golf putt-line between a point of origin and the hole to provide an offset distance at which the golfer should aim his/her golf stroke.

Golf begins with the "long game", which involves driving the ball toward the hole over a significant distance using an aggressive stroke. The object of the long game is to get the golf ball as close to the hole as possible, to minimize the distance between the ball and hole during "putting".

Putting involves gentler, controlled strokes that seek to gently move the ball toward the hole—or at least close the distance between the ball and hole. Considerable precision is required during putting. Analogous to driving, where the golf ball is subject to the influence by air currents, during putting the golf ball is subject to influence by the terrain of the putting green. In particular, the slope of the terrain has a significant effect on the trajectory of the ball. Even when the ball is aimed precisely at the hole, a sloped terrain will cause the ball to deviate significantly from its intended target. Accordingly, when the putting green is sloped, even a relatively short putt can miss the mark.

U.S. Pat. No. 5,330,188 to Reimers discloses a putter alignment system that uses a signal emitter mounted on the putting head, and remote target component placed behind the hole to help train a golfer to aim the putter on a straight line, centered with the hole. As discussed above, aiming for the center of the hole has little value on a sloped putting green. Accordingly, Reimers has little value in training a golfer how to alter the trajectory of the putt to compensate for the sloped green.

Similar to Reimers, Chen discloses a golf training device that emits a light beam from a central point on the putter head, and indicates to the golfer when the beam is in alignment with the target. Also similar to Reimers, U.S. Pat. No. 5,692,966 to Wash discloses a golf putting training device that helps train a golfer to aim the putter head perpendicular to the putt line, by indicating when the putter head is parallel to the electronic training device. Accordingly, Wash and Chen have little value for training a golfer to compensate for slope during putting.

U.S. Pat. No. 5,818,036 to Daly discloses a laser aided practice putting device and method. In particular, Daly discloses a device which emitters a visible beam of laser light from a target to act as a fixed guide to help the golfer find a straight line to the target.

U.S. Pat. No. 6,129,641 to Burch discloses a golf putting scope, which functions as a periscope, such that the golfer can look downward into the scope to see if and how the ground slopes between the ball position and the flag. Burch, however, does not measure the slope along the putt line, nor does it provide any guidance as to how the golfer must alter the putt to successfully reach the hole.

Further examples of devices that attempt to improve a golfer's putting stroke are provided by U.S. Pat. No. 6,458,038 to Lin and U.S. Pat. No. 6,461,247 to Riddell. Lin discloses a golf putting indication device that uses a plurality of honeycombed sensors to measure the arch of a putter swing. Riddell discloses a device that employs a pair of spaced members, and a pair of cords extending between the members, and allows a golfer to realize the linearity of the putting stroke.

While these units may be suitable for the particular purpose employed, or for general use, they would not be as suitable for the purposes of the present invention as disclosed hereafter.

SUMMARY OF THE INVENTION

It is an object of the invention to produce a golf putting aid that helps a golfer successfully achieve a putt on a sloped putting green. Accordingly, the present invention provides a variance determining system that indicates to a golfer the distance to vary the putt in view of the terrain.

It is another object of the invention to provide a golf putting aid that assesses the slope of the putting green and provides the golfer with a numeric output which instructs the golfer to aim off-center from the hole by that numeric output.

It is a further object of the invention to provide a golf putting aid that is suitable for use on a putting green where the slope changes along the putt line. Accordingly, the variance determining system samples the slope at various points along the putt line in order to make an accurate offset-distance recommendation.

It is a still further object of the invention to provide a golf putting aid that provides a way for the golfer to use the offset-distance recommendation and adjust the putt-line appropriately. Accordingly, a target is provided which sits behind the hole and allows the device to measure the distance to the hole at each of the slope measurements, and then provides a calibrated surface that allows the golfer to appropriately adjust the putt angle by the offset-distance recommendation.

The invention is an offset measurement system, for aiding a golfer when putting upon a putting green having varying slope between a golf ball, resting upon the green, and a hole having a hole center. A target having a target line is positioned at the hole with the target line aligned with a direct putt line that connects the hole center and ball. A measurement device is used to acquire multiple measurement data sets having the slope of the putting green at a position along the direct putt line and a distance to the target at that position. The measurement device calculates and displays a recommended offset distance from the measurement data sets that is used by the golfer to redirect the putt at the hole by the recommended offset distance from the direct putt line.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
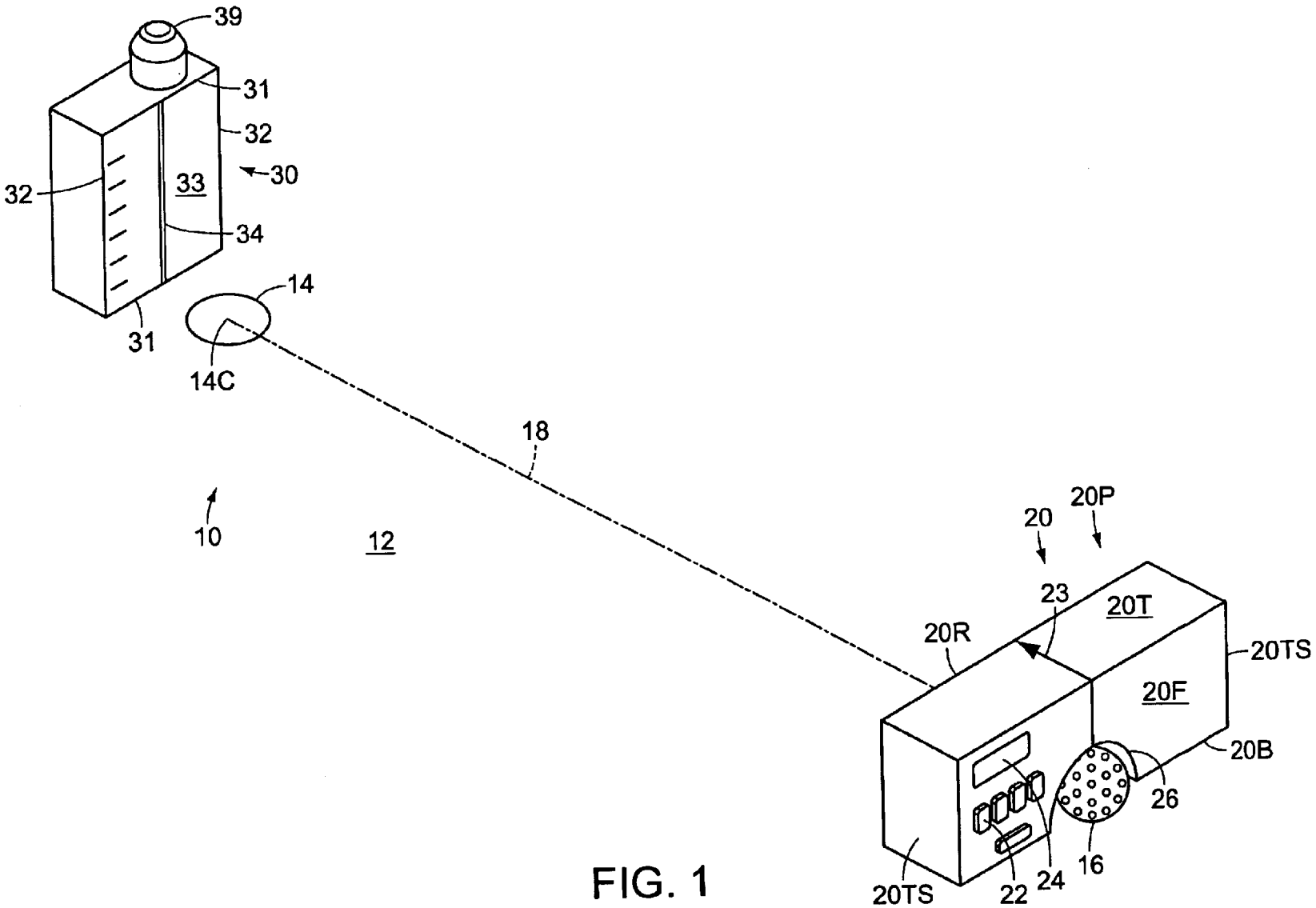
FIG. 1 is a diagrammatic perspective view illustrating the present invention, wherein a measuring target is positioned behind a putting green hole, and a measuring device is positioned over a golf ball, with a direct putt line illustrated in phantom extending between the golf ball and the hole.

FIG. 1 illustrates an offset determining system 10, for use by a golfer, when putting upon a putting green 12, having a hole 14. The hole 14 has a hole center 14C. A golf ball 16 is positioned a distance from the hole 14. A direct putt line 18 connects the golf ball 16 and the hole center 14C.

The offset determining system 10 includes a measuring device 20 and a measuring target 30. The target 30 is substantially rectangular, having a pair of short sides 31 and a pair of long sides 32. The target has a target face 33 having a target line 34 visible thereon, extending longitudinally such that the target line 34 is substantially parallel to the long sides 32. The target 30 is adapted to stand upright upon the putting green 12, such that the target face 33 is perpendicular to the putting green 12. When the offset determining system 10 is used to ascertain an offset distance, the target line 34 is positioned as illustrated, such that it extends vertically behind the hole 14 such that the target line 34 is aligned with the direct putt line 18. In particular, the golfer initially positions the measuring target 30 by aligning the target line 34 with the golf ball 16, through the hole center 14C. The target face may be reflective to facilitate proper alignment of the target 30, and of the measurement device with the target 30 in the manner described hereinafter. The target 30 may also have a protrusion 39 extending from one of the short sides that is sized and shaped to fit within the hole 14 for allowing the target 30 to be placed directly over the hole, with said short side 31 extending across the hole 14 and upon the putting green 12.

The measuring device 20 has a housing 21 having a top 20T, a bottom 20B, side edges 20S, a front 20F and a rear 20R. A positioning arrow 23 is imprinted on the top 20T, directed toward the front 20F and perpendicular thereto. Selection buttons 22 and a display 24 are located on the rear 20F.

According to the embodiment of the invention illustrated, an arched tunnel 26 extends fully between the front 20F and rear 20R and is open at the bottom 20B fully therebetween. According to this embodiment, the measuring device 20 is positioned over the golf ball 16 with the golf ball 16 in the arched tunnel 26. In this maximum position 20P, an initial measurement is taken.

The measuring device 20 collects measurement data sets, which comprise a slope angle and a distance to the hole 14 at its current location. Accordingly, the measuring device 20 contains at least one inclinometer and a rangefinder. The rangefinder may be an ultrasonic module that measures the distance from the front 20F of the housing 21 to the target 30, or any other suitable technology capable of measuring the distance from the front 20F of the housing 21 to the target 30. The inclinometer may be oriented longitudinally across the housing 21, substantially parallel to the front 20F, rear 20R, and bottom 20B. In this position, the inclinometer measures a transverse slope—that is, transverse to the direct putt line 18. It should be noted that for the purposes of the present invention, the golf ball may be substituted with a marker—which is especially helpful in embodiments of the invention that do not have the arched tunnel 26.

Accordingly, the measuring device 20 takes an initial measurement at the maximum position 20P illustrated in FIG. 1, and acquires a measurement data set thereat, which comprises the maximum distance to the hole 14 and the transverse slope at the measuring device. Of course, the measurement data set taken at the maximum position is useful for determining the potential variance of the ball from a straight-line trajectory. Considering that the slope is rarely consistent along the direct putt line, such data is a very rough approximation of the trajectory.

Figure 2:
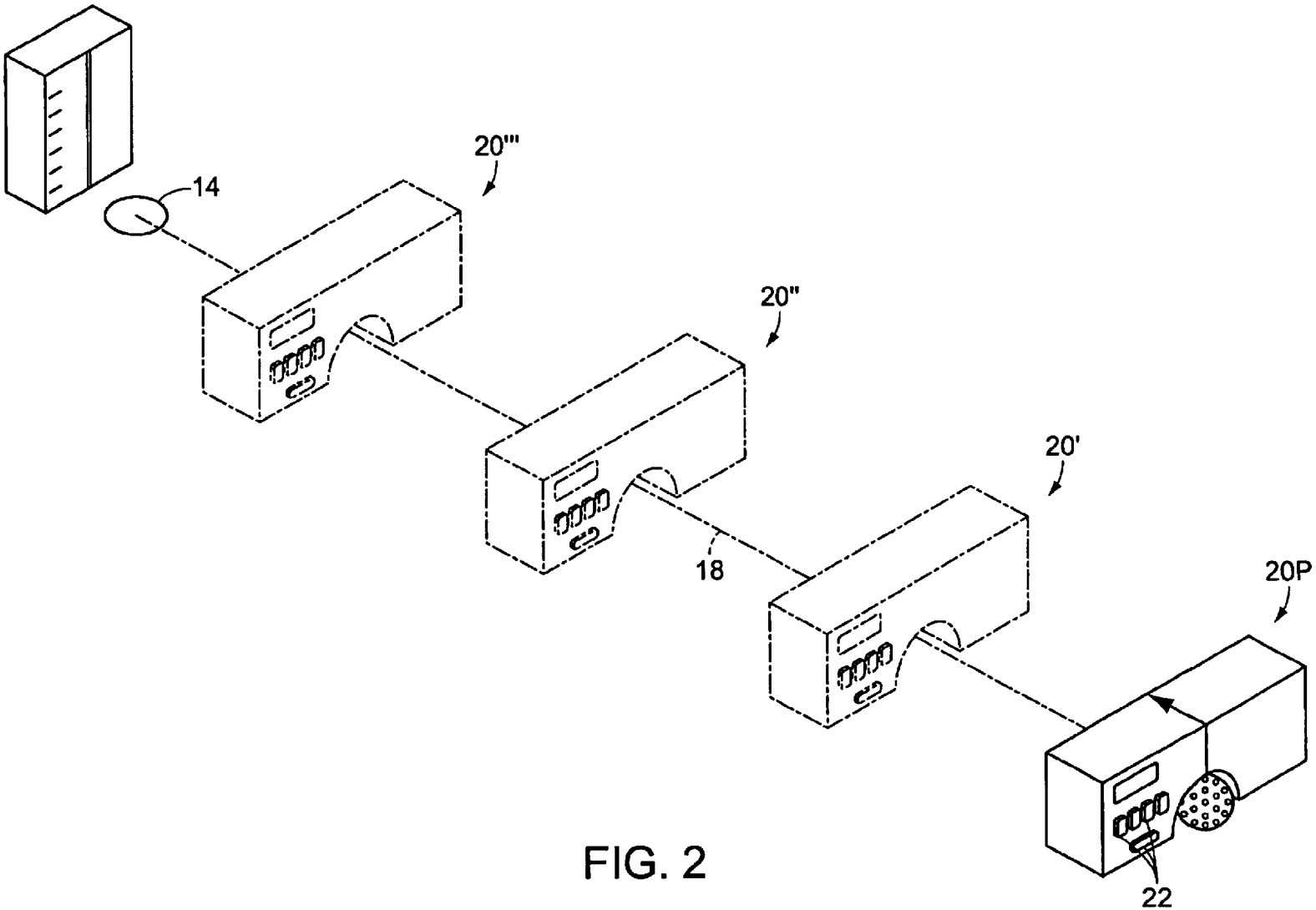
FIG. 2 is a diagrammatic perspective view, illustrating the measuring device positioned at multiple positions along the direct putt line, whereas measurements are taken at each of these multiple positions.

Referring then to FIG. 2, according to the present invention, multiple measurement data sets are acquired at various positions (20', 20", 20"') further along the direct putt line than the maximum position 20P. Thus, at each of these positions, the slope is measured and is associated with the distance from the hole thereat. In particular, the measuring device 20 is repositioned along the direct putt line 18, and one of the selection buttons 22 is pressed to initiate the acquisition of a measurement data set. Once the measurement has been taken, the measuring device 20 may indicate the same to the golfer using audible and or visual means. Multiple iterations of repositioning the measurement device and initiating a measurement, while moving the measuring device 20 toward the hole 14 along the direct putt line are performed by the golfer. Through the acquisition of numerous measurement data sets—or samples—the topography along the putt line is most closely mathematically modeled.

After sufficient measurements have been made, or when a calculation is requested by the golfer using the selection buttons 22, the measurement device calculates a recommended offset distance, visually indicates said recommended offset distance on the display 24, and may audibly indicate the recommended offset distance through speech synthesis. To facilitate easy reading by the golfer, the display 24 may be angled upward.

Figure 6:
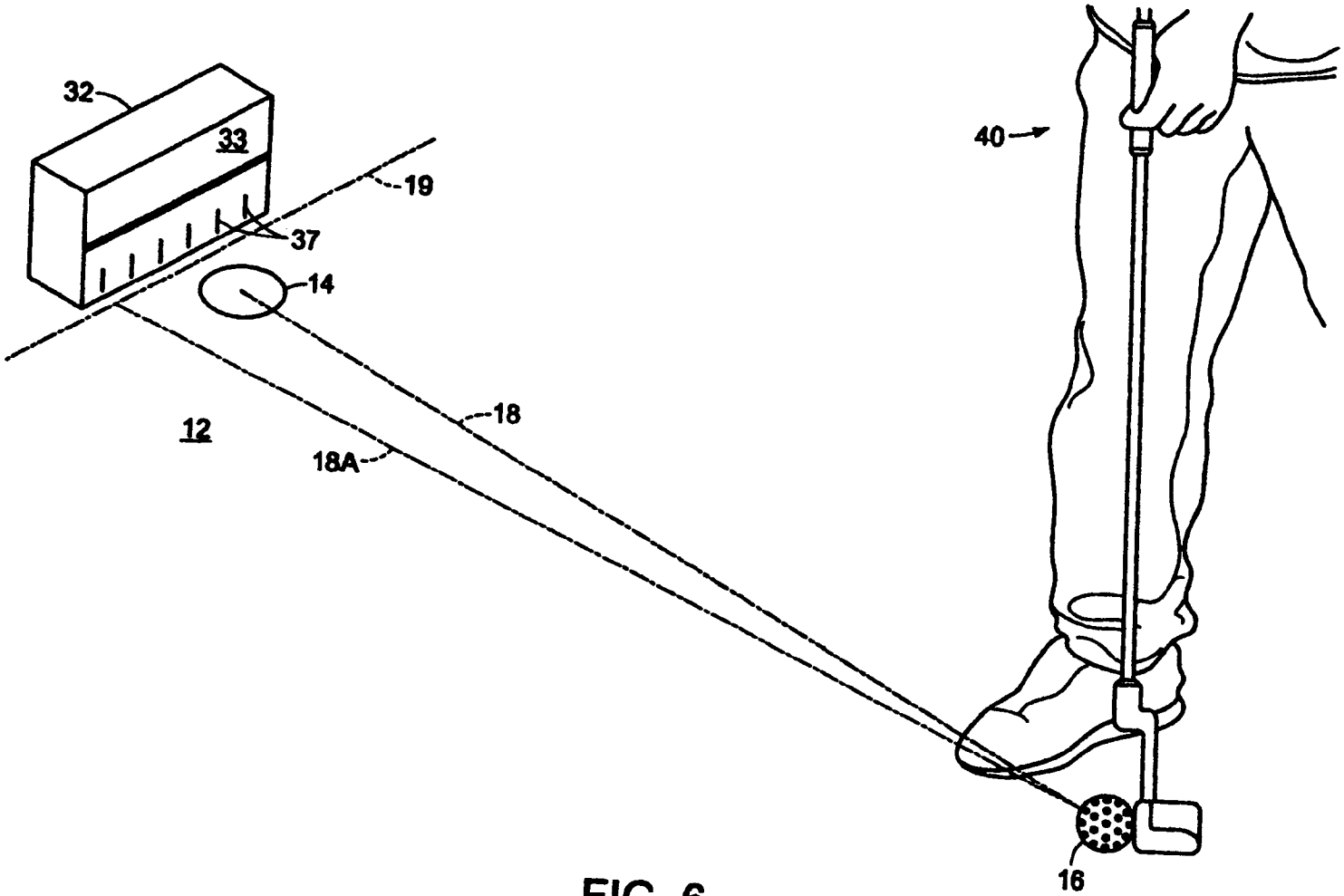
FIG. 6 is a diagrammatic perspective view, illustrating the measuring target being used to guide the golfer to redirect the putt line according to the recommended offset distance.

The recommended offset distance is a vector of the distance along an offset line 19 that is adjacent to the hole and transverse to the direct putt line 18. The recommended offset distance tells the golfer 40 how far to the left or right of the direct putt line to redirect the putt. Accordingly, referring to FIG. 6, the recommended offset distance suggests a redirected putt line 18A to the golfer. The redirected putt line is intended to compensate for the average slope between the maximum position and the hole so that if the golf ball 16 is accurately hit along the redirected putt line 18A, the slope of the putting green will carry the ball toward the hole 14.

To help the golfer 40 implement the recommended offset distance to aim the stroke along the redirected putt line 18A, the target 30 is rotated, so that one of the long sides 32 is laid upon the putting green 12 immediately behind the hole 14, centered with respect to the direct putt line 18, with the target line facing the golf ball, and thus the golfer. Accordingly the target face 33 has a series of calibrated lines 37 along at least one of the long sides 32, which indicate various distances from the center of said long side 32. The calibrations preferably indicate distances in both the metric and English measurement systems. Accordingly, the measurement device 20 preferably selectively displays the recommended offset distance in both inches and centimeters.

The recommended offset distance is calculated by any algorithm, which may be determined by those of ordinary skill in the art without undue experimentation, which can determine the recommended offset distance using the mathematical modeling of the topography between the putt line and hole 14 formed by the measurement data sets and the application of general principles of physics and trigonometry.

An example of the algorithm is as follows: sum the horizontal (transverse) components and vertical (longitudinal) components of vectors created by each measurement data set. Create a resultant vector from the summed horizontal and vertical components. Determine the recommended offset distance by multiplying the sin of the resultant vector angle by the maximum distance, and adjusting that result by a factor or constant to compensate for surface resistance and perhaps for the short distance between the offset line 19 and the center of the hole 14C.

Figure 3:
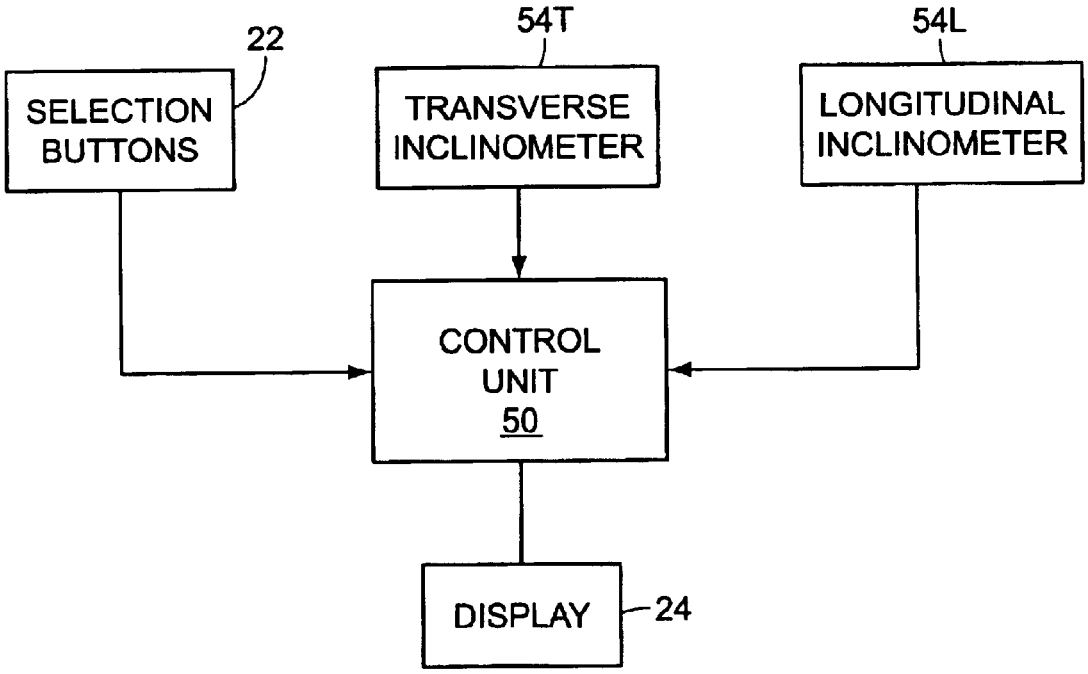
FIG. 3 is a block diagram, illustrating the major functional components of an embodiment of the measuring device.

To aid the measurement device in implementing this functionality and communicating with the user/golfer, the selection buttons 22 preferably include a READ button, which prompts a reading and the acquisition of a measurement set; a DATA button, which scrolls through all current measurement sets; a CLEAR button which, clears all previous readings; a MODE button, which selectively chooses display of readings in the metric or English measurement systems; and a P-LINE button, which prompts a calculation of the recommended offset distance. Referring to FIG. 3, the measurement device 20 has a control unit 50, which receives input from the selection buttons 22, and calculates the recommended offset distance and visually indicates the same on the display 24. The control unit also accepts inputs from a transverse inclinometer 54T, and according to a further embodiment of the invention: from a longitudinal inclinometer 54L.

Figure 5:
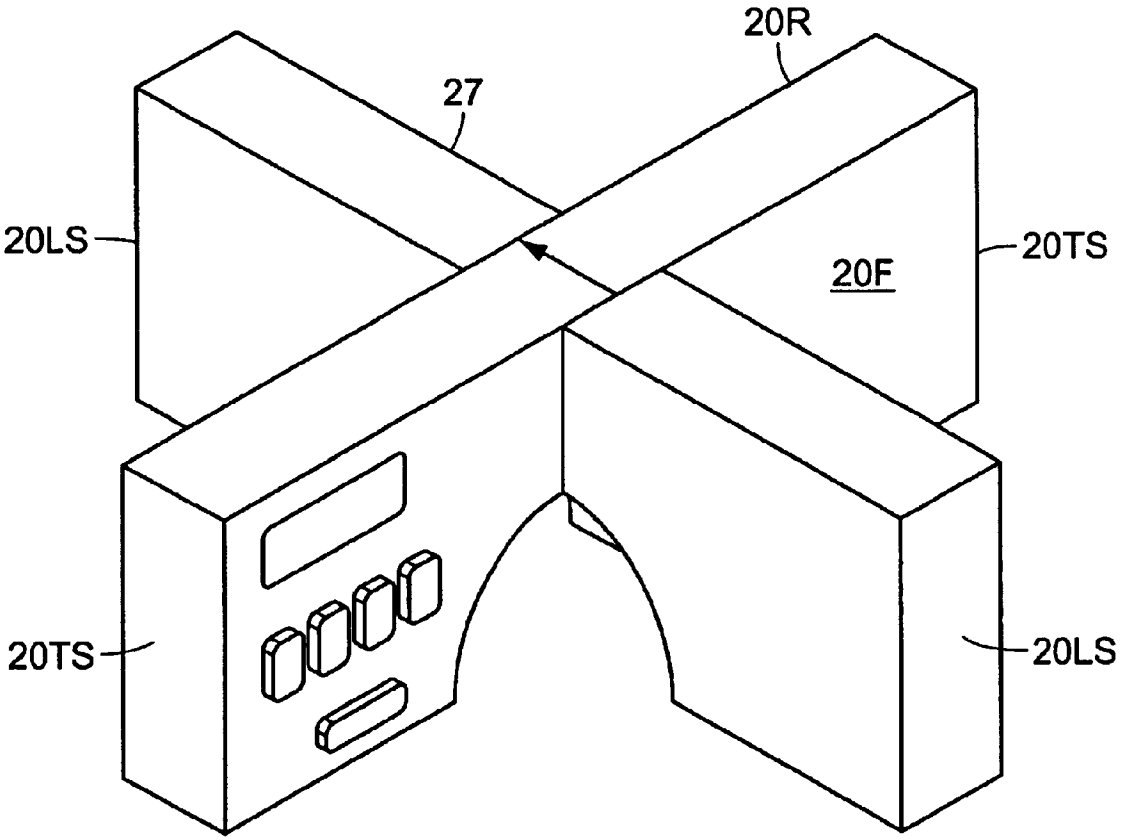
FIG. 5 is a diagrammatic perspective view, illustrating a further embodiment of the invention.

FIG. 5 outwardly illustrates the further embodiment of the invention having the longitudinal inclinometer. In particular, the housing 21 has a cross member 27 which extends perpendicularly from the front 20F to the rear 20R. On the cross member 27, the housing 21 has a pair of longitudinal sides 20LS. In particular, the longitudinal sides 20LS of the cross member 27 extends forwardly and rearwardly substantially as far as the distance between the transverse sides 20TS of the housing 21. Accordingly, when placed upon the golfing green, the bottom 20B of the housing 21 will engage the ground surface at the transverse sides 20TS and longitudinal sides 20LS. The housing 21 will enter a position that approximates the slope of the putting green 12 in both the transverse and longitudinal directions. Thus, according to the embodiment shown in FIG. 5, a pair of inclinometers are present within the housing 21—namely the longitudinal inclinometer extending longitudinally parallel to the bottom 20B and the transverse inclinometer extending transversely parallel to the bottom 20B. The measurement device 20 is used just as previously described, where the positioning arrow is aligned with the direct putt line 18. Multiple measurement sets are acquired—first at the maximum position, and then at subsequent positions along the direct putt line 18. Then, the offset distance is calculated from a three dimensional mathematical modeling of the golfing green to provide a recommended offset distance which more precisely indicates where the golfer should aim the golf stroke.

Figure 4:
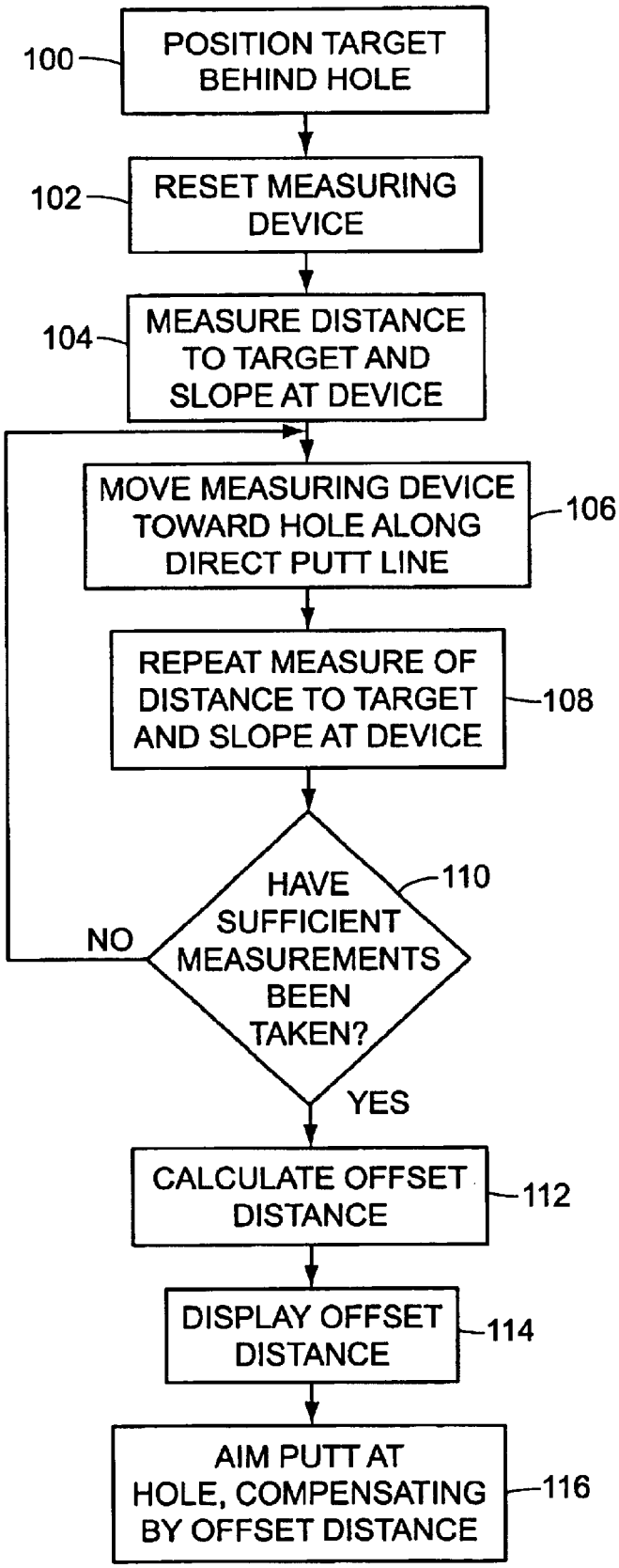
FIG. 4 is a flow diagram, illustrating steps in determining a recommended offset distance.

Accordingly, then, usage of the offset determining system and the procedure followed according to the present invention is illustrated in the flow diagram of FIG. 4. In particular, the target is initially positioned behind the hole 100. Then the measuring device is reset 102, such that it is cleared of any measurement sets in memory such that it is ready to take measurements for a new putt, and the measuring device is placed at the maximum position—directly over the golf ball on the putting green. Then, the distance to the target and slope is measured at the device 104. Then, the measuring device is moved toward the hole along the direct putt line 106, and the measurement of the distance to the target and the slope at the device is repeated 108. Then, it is determined whether sufficient measurements have been taken 110. Such determination may be made by the device, but is most probably made by the golfer/user. If insufficient measurements have been taken to precisely model the topography of the putting green, the steps of moving the measuring device toward the hole along the direct putt line 106 and taking repeated measurements of the slope and distance to the target 108 are carried out until sufficient measurements have been taken. Once sufficient measurements have been taken, the recommended offset distance is calculated by the device 112, and displayed on the device 114. With the recommended offset distance in hand, the golfer aims the putt toward the hole, compensating for the recommended offset distance 116.

In conclusion, herein is presented a system for determining a recommended offset distance for a golfer while putting, taking into account the topography of the putting green between the ball and the hole. The invention is illustrated by example in the drawing figures, and throughout the written description. It should be understood that numerous variations are possible, while adhering to the inventive concept. Such variations are contemplated as being a part of the present invention.

What is claimed is:

1. A offset determining system, upon a putting green having a topography of varying slope, for use by a golfer in hitting a golf ball from a maximum position toward a hole having a hole center, to suggest to the golfer a redirected putt line that varies by an offset distance transverse to and at the hole from a direct putt line which extends between the ball and the hole center, comprising:

a target having a target face having a target line extending thereon, the target for positioning adjacent the hole with the target line aligned with the direct putt line; and a measurement device having a housing having a top, a bottom, a pair of transverse sides, a rear, and a front, and positioning indicia for aligning the rear transverse to the direct putt line, the measurement device having a transverse inclinometer extending longitudinally between the transverse sides and substantially parallel to the bottom, the measurement device having a rangefinder for determining distance between the front and the target, the measurement device having a control unit for determining the offset distance from at least two measurement sets each having a distance to the target and a slope at that distance and a display for providing the offset distance to the user, wherein one of the measurement sets is acquired upon placing the measurement device at the maximum position, and another of the measurement sets acquired upon placing the measurement device further toward the hole along the direct putt line.

2. The offset determining system as recited in claim 1, wherein the target has a pair of short sides and a pair of long sides, such that when acquiring the measurement sets, one of the short sides is positioned on the green such that the target line extends vertically behind the hole.

3. The offset determining system as recited in claim 2, wherein the target face has a plurality of calibrated lines along at least one of the long sides, which indicate various distances from a center of said long side, such that said long side is positioned upon the putting green transverse to the direct putt line after the offset distance is calculated, to help the golfer redirect the putt line by using the calibrated markings to redirect the putt line by said offset distance.

4. The offset determining system as recited in claim 3, wherein the measurement device has a longitudinal inclinometer, extending longitudinally between the front and rear, such that each of the measurement sets includes and longitudinal slope and a transverse slope.

5. The offset determining system as recited in claim 4, wherein the measurement device has a display for visually indicating the recommended offset distance and has selection buttons for allowing the user to control functionality of the measurement device.

6. The offset determining system as recited in claim 5, wherein the measurement device has an arched tunnel centered between the transverse sides and extending longitudinally from the front for positioning the golf ball within the archway when the measurement device is at the maximum position.

7. The offset determining system as recited in claim 6, wherein the selector buttons include a read button for prompting the acquisition of a measurement set and a button for prompting the calculation and display of the recommended offset distance.

8. The offset determining system as recited in claim 7, wherein one of the short sides has a protrusion sized and shaped for extending within the hole to allow the target to be positioned upon the putting green with said short side extending across the hole.

9. The offset determining system as recited in claim 8, wherein the selector buttons include a data button for displaying the measurement sets that have been acquired.

10. The offset determining system as recited in claim 9, wherein the selector buttons include a mode button for selectively displaying the recommended offset distance in British and metric units.

11. An offset determining method for use by a golfer on a putting green having a hole having a hole center, in putting a golf ball on the green toward the hole, where the golf ball is located at a maximum position, a direct putt line connects the ball with the hole center, an offset line extends transverse to the direct putt line at the hole, and the putting green has a topography of varying slope, using a measurement target having a target face having a target line visible thereon, and using a measurement device having a housing having a bottom, a front, a rear, a pair of transverse sides, a rangefinder at the rear, an inclinometer extending parallel to the bottom between the transverse sides, comprising the steps of:

(a) aligning the target line with the direct putt line by positioning the target at the hole;

(b) positioning the measurement device at the maximum position by placing the bottom upon the putting green;

(c) acquiring a measurement data set at the maximum position by measuring the slope by the inclinometer and the distance to the target by the rangefinder;

(d) repositioning the measurement device along the putt line closer to the hole than the maximum position by placing the bottom upon the putting green;

(e) acquiring another measurement data set by measuring the slope of the putting green using the inclinometer and the distance to the target using the rangefinder;

(f) calculating a recommended offset distance by the device using the measurement data sets; and (g) aiming the putt by the golfer at the hole, redirected by the recommended offset distance on the offset line.

12. The offset determining method as recited in claim 11, wherein the measurement device has selector buttons, wherein steps (c), (e), and (f) further comprise pressing one of the selector buttons by the user.

13. The offset determining method as recited in claim 12, further comprising repeating steps (d) and (e) to allow precise mathematical modeling of the topography along the direct putt line.

14. The offset determining method as recited in claim 13, wherein the measurement device has both a transverse inclinometer and a longitudinal inclinometer, both extending parallel to the bottom, and wherein steps (c) and (e) further comprise acquiring both transverse and longitudinal slopes.

15. The offset determining method as recited in claim 14, wherein the target has a pair of short sides and a pair of long sides, the target line extending longitudinally parallel to the long sides, the target having a plurality of calibrated lines located along one of the long sides which are spaced to indicate distances therealong; wherein the step of aligning the target line with the direct putt line further comprises positioning one of the short sides upon the putting green; and wherein step (g) of aiming the putt by the golfer at the hole:

is preceded by the step of positioning the target upon one of the long sides by rotating the target, and further comprises aiming the putt at the one of the calibrated lines on the target corresponding to the recommended offset distance.

16. The offset determining method as recited in claim 15, wherein the measuring device has an arched tunnel extending upward from the bottom and rearwardly from the from the front, and wherein the step of positioning the measurement device at the maximum position further comprises positioning the measurement device with the arched tunnel extending over the golf ball.

17. The offset determining method as recited in claim 16, wherein the measurement device has a display, and wherein the method as recited further comprises visually indicating the recommended offset distance to the user with the display.

* * * * *